US008657351B2

(12) United States Patent
Johnson

(10) Patent No.: US 8,657,351 B2
(45) Date of Patent: Feb. 25, 2014

(54) GOLF DISC AND FLYING DISC AND MULTIPURPOSE PICK UP TOOL

(76) Inventor: Joseph Allen Johnson, Woodbridge, CA (US)

( * ) Notice: Subject to any disclaimer, the term of this patent is extended or adjusted under 35 U.S.C. 154(b) by 710 days.

(21) Appl. No.: 12/283,242

(22) Filed: Sep. 9, 2008

(65) Prior Publication Data

US 2009/0115211 A1 May 7, 2009

Related U.S. Application Data

(60) Provisional application No. 61/001,632, filed on Nov. 2, 2007.

(51) Int. Cl.
*B25J 1/00* (2006.01)

(52) U.S. Cl.
USPC ..... 294/19.2; 473/131; 473/286; 135/74; 403/225; 403/291; D21/789; D21/721

(58) Field of Classification Search
USPC ..... 294/65.5, 51, 26; 473/286, 131; D21/789, 721; 15/105, 144.1, 144.2, 15/144.3; 135/74, 143; 7/167, 901; 403/291, 225, 220
See application file for complete search history.

(56) References Cited

U.S. PATENT DOCUMENTS 2,750,222 A * 6/1956 Borah ..... 294/19.2
3,669,133 A * 6/1972 Hyman ..... 135/74
4,776,361 A * 10/1988 Staton ..... 135/65
4,901,606 A * 2/1990 Christensen ..... 81/57.11
4,962,957 A * 10/1990 Traber ..... 294/19.1
5,065,537 A * 11/1991 Bailey ..... 40/618
5,165,744 A * 11/1992 Vogrin ..... 294/19.2
5,205,598 A * 4/1993 Miller ..... 294/19.2
5,823,592 A * 10/1998 Kalidindi ..... 294/24
6,126,028 A * 10/2000 Buckley ..... 220/3.8
6,453,777 B1 * 9/2002 Newman et al. ..... 81/53.11
6,553,872 B1 * 4/2003 Tse et al. ..... 81/53.11
6,705,654 B2 3/2004 Slauf
6,852,040 B1 * 2/2005 Williams ..... 473/286
6,899,635 B2 * 5/2005 Nadratowski et al. ..... 473/285
7,131,352 B1 * 11/2006 Saunders ..... 81/53.11
7,320,489 B1 1/2008 Domb
7,367,347 B2 * 5/2008 Field ..... 135/66
2004/0135387 A1 * 7/2004 Keith et al. ..... 294/19.1
2006/0055189 A1 * 3/2006 Dalsing et al. ..... 294/19.2

* cited by examiner

*Primary Examiner* — Christopher J Novosad

(57) ABSTRACT

The GOLF DISC AND FLYING DISC AND MULTIPURPOSE PICK UP TOOL is a lightweight, collapsible, segmented shaft fitted with a durable suction cup. The suction cup provides a vacuum adhesion on either side, or any location, on the golf disc or flying disc or other generally flat and smooth objects. The disc or object can then be picked up (retrieved) from any surface or obstacle within reach. A flick of the finger to the suction cup edge breaks the vacuum and the tool and disc or object are separated. The tool can be deployed and used with one hand. The tool can be carried and used as extended or folded and stowed.

3 Claims, 1 Drawing Sheet

GOLF DISC AND FLYING DISC AND MULTIPURPOSE PICK UP TOOL

SUMMARY

The GOLF DISC AND FLYING DISC AND MULTIPURPOSE PICK UP TOOL is a lightweight, collapsible, segmented shaft fitted with a durable suction cup. The suction cup provides a vacuum adhesion on either side, or any location, on the golf disc or flying disc or other generally flat and smooth objects. The disc or object can then be picked up (retrieved) from any surface or obstacle within reach.

BACKGROUND

Disc golf is played and scored just as a game of regular "ball" golf. Instead of balls, plastic flying discs are used. Golf discs are smaller and heavier than the common "Frisbee" type disc. There are pole mounted, elevated metal baskets for "holes" and common Tee-Off pads from which to throw a disc. The game is scored just as regular golf: A player is given a designated number of throws to score "even", also known as "par". A player may throw any number of times, depending on course, weather conditions and skill. Thrown (played) golf discs can land anywhere one can imagine: flat on the ground, in weeds, in water, in bushes or trees, in crevices, or under logs.

Need for this Tool:

In a typical single game of 18 hole, par 3 per "hole" disc golf, one can expect to bend or squat down and pick up a disc at least 54 times, if one is lucky to make "even" par. A typical golf game can require a thrower to pick up discs 100s of times. A typical practice session can also cause a player to throw and pick up discs 100s of times. My invention eliminates squatting, bending, reaching, or stooping for ones' discs or other objects. This tool is deployed and readied with one hand, in one motion, and retrieves the disc quickly and securely. It is a time saver and a back saver. Other generally flat and smooth objects and items such as playing cards, poker chips, or cell phones are similarly easily retrieved.

DRAWING SPECIFICATIONS

Referring to the drawing, which forms a part of this specification:

Figure 1:
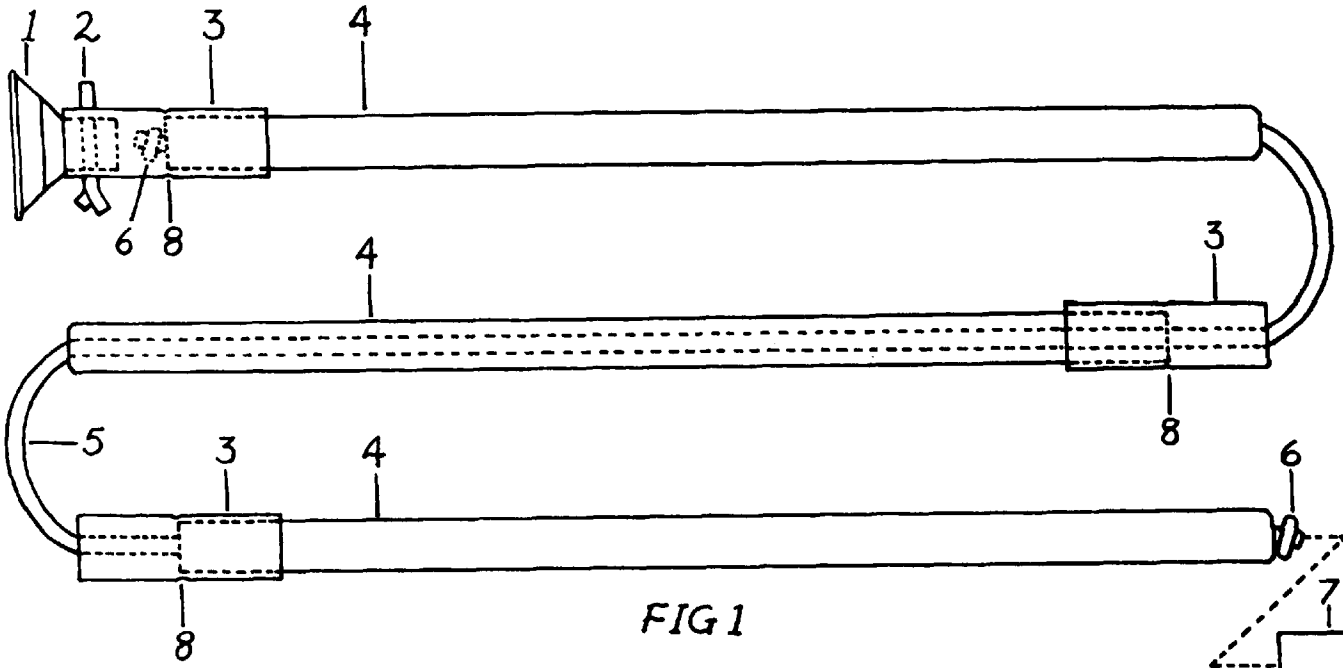
FIG. 1 shows the collapsed tool with the shock cord in relaxed state to simplify the drawing and descriptions. The finished tool would have tension on the shock cord.
Figure 2:
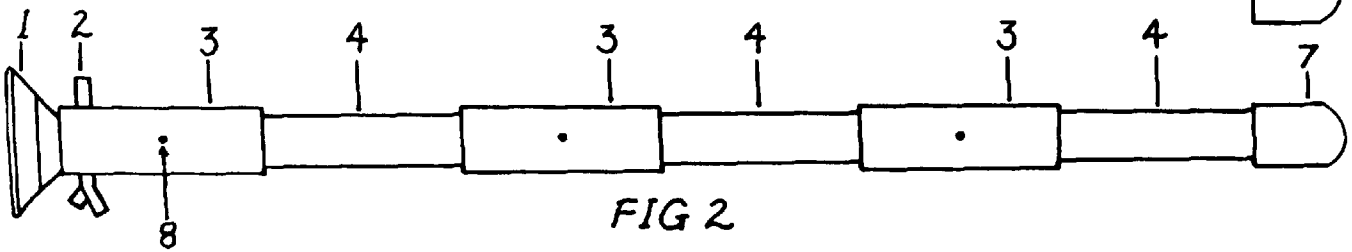
FIG. 2 shows the finished tool as deployed (unfolded), and ready for use.

FIG. 1:

Item 1 is the suction cup

Item 2 is the cotter pin

Item 3 is the metal tubing coupling sleeve

Item 4 is the fiberglass segment

Item 5 is the "Shock Cord" (stretch cord)

Item 6 is a knot tied in the cord

Item 7 is a plastic cap

Item 8 shows the staking positions on item 3

FIG. 2:

Items 1, 2, 3, 4,7 and 8 as visible in a finished, unfolded, deployed tool.

Technical Design Description (Specification):

GOLF DISC AND FLYING DISC AND MULTIPURPOSE PICK UP TOOL is a multi-segmented, collapsible, hollow fiberglass shaft, (thick-walled tubing), fitted with a suction cup at the distal end. The segments (Item 4) are fiberglass tubing ⅜ inches in diameter with an ⅛ diameter through-hole and each segment is 11 inches total length. All three segments have a two inch long metal tubing coupling sleeve (Item 3) attached to one end by friction, glue and punch staked (Item 8). The sleeve is attached one inch from end on the segment. The coupling sleeves have sufficient inside diameter to loosely receive the next segment. The distal segment coupling sleeve serves as the fixation point of the suction cup. All exposed fiberglass ends are beveled and sanded for fit and finish. The segments have a measured length of stretch cord (shock cord) (Item 5) running through the center and tied (Item 6) at either end with sufficient pre-stretch as to allow the deployed tool segments to fit snug enough to pick up a disc without disjoining, but loose enough to allow pulling apart the segments for folding (stowing). The proximal segment has a plastic cap (Item 7) slid over the end to dress the tool and protect the stretch cord knot. The distal end of the tool has a one inch diameter durable plastic suction cup (Item 1) slid in and pinned horizontally to the bottom coupling. The pin (Item 2) attaches through two holes drilled directly across from one another. Other diameter suction cups can be attached in the same manner. Note: Segments can be made of fiberglass, aluminum, or other plastics or metals. I chose fiberglass because of lightness, strength, and durability.

How I Made it:

Cut three like sizes of measured fiberglass tubing. These lengths of fiberglass tubing are now the "segments" (Item 4). Cut three like sizes of metal tubing. These lengths of metal tubing sleeves are now the "couplings" (Item 3). The couplings will have an inside diameter sufficient as to allow a tight fit on the outside ends of the segments during assembly.

Secure a segment and glue and force fit a length of coupling to one end. Slide the ends together for half the distance of the coupling. Assemble two more identical segments. Secure each segment in a suitable vise holding the segment on the coupling end. Stake punch the segment couplings once in the center equidistant from the ends to trap the glued sections together (Item 8).

Secure one segment. This segment will be the "distal" segment. Locate coupling end. Clamp coupling. Using a machine drill, drill two holes in a sufficient perpendicular location horizontally so as to slide a small cotter pin through the coupling. Locate the holes in sufficient location so as to be in the center of the protruding mounting stub on the suction cup. These three assembled segments are now the "finished segments". Slide the finished segments together, male-female order. These finished segments are now the tool, without the suction cup. The tool, as positioned properly, will have a coupling at the distal end and a finished fiberglass end at the proximal end.

Secure a length of shock cord (Item 5) sufficient to pass through the tool with enough excess length needed to tie a simple overhand knot (Item 6). Slide the shock cord all the way through the joints.

The shock cord end shall be flame heated on the ends to dress the cord, prohibit fraying, and facilitate easy insertion through the segments. On the non-drilled (proximal) end, tie a common overhand knot. On the distal end, grasp the shock cord and pull so as to cause a pre-tensioned state of the cord. Place a common clothespin at the coupling to hold the tensioned cord so as to make tying off the cord easier. Tie a simple overhand knot, cut the excess, and dress the frayed end as described above. Allow the cord to contract and pre-tension the tool. Locate the distal end. Secure a suction cup (Item 1). Pre-drill a hole of sufficient size as to allow a small cotter pin (Item 2) to pass through. Drill the hole horizontally in the center of the suction cup stub. Slide the pre-drilled stub end into the pre-drilled coupling. Slide a sufficient size cotter pin through the coupling and suction cup. To finish and secure the cup assembly, bend the cotter pin ends accordingly. Friction fit a small plastic cap (Item 7) on the proximal end to dress and protect the shock cord knot and provide comfort to the user. The finished tool is painted, covered, or adorned for durability and aesthetics.

Tool Deployment Procedure (How To Use):

Secure a tool in the folded (stowed) position. With either hand, grasp the proximal (non-suction cup end) of the pick up tool. While holding the top section, simply allow the remaining segments to gravitate down and snap automatically and positively in place. Locate the disc or object to pick up. The suction cup end of the tool is then pressed against either side of the disc, back or front, as landed in play. Positive and tight suction is quickly and easily attained. The disc is "locked" and the disc may be raised for storage or further play. The tool can be "stuck" to any area of the disc. Middle placement is not required. For instance, if only a small edge of the disc protrudes from under a log, the tool can lock on to just enough disc to allow the suction cup to press in. This entire operation can be done one-handed and takes seconds. A quick flick of a finger to the edge of the suction cup breaks the suction seal and the disc comes free from the tool. The tool can be folded back up and stowed or carried fully extended (deployed).

Design Uniqueness:

My design is vastly different than any other design for the following reasons: Tool can be fully extended and locked with one hand, using one motion. Other designs make use of both hands for extension and "lock" of the folding tubular sections and then both hands are needed for screwing on various attachments. This tool design uses a small, strong, and durable suction cup device which attaches to, and locks on the disc utilizing a vacuum. This action enables the person retrieving the disc to lift the disc to a position to easily grasp the disc. Other designs such as a hook of any type can only drag the disc and one still has to bend, reach or grasp in some other way, the retrieved disc.

A typical golf "disc" is a solid, smooth plastic and typically lands flat when thrown. A disc golf disc is unlike a traditional "Frisbee" flying disc because the disc golf disc is smaller, heavier, and flatter. There are no holes, ledges or other areas in which a hook can be placed for positive retrieval. Any "hook" type retriever can only drag the disc. This dragging and hooking action will certainly scratch, gouge and mar the disc. My design positively and securely grabs the disc, and will not come free until removed by the disc golfer. Disc can be retrieved and removed from the suction device all with the same hand. This device really picks up the disc and gets it back into the golfers hand. It doesn't merely hook the disc and require the player to carefully drag or suspend the disc so it can be quickly grabbed before it can again fall to the ground.

My design enables a disc golfer, for instance, to retrieve a disc from under the water or above in a tree without the disc being merely hooked and moved to another location and perhaps falling back into the water or out of the tree onto the ground. My design eliminates this fatal design flaw in that the disc remains securely locked onto the tool until the disc golfer physically disengages the suction cup by simply breaking the suction with a finger or finger nail.

My design will enable a physically challenged player to retrieve a disc off any surface without any bending at all. This action is accomplished in one motion: pointing the tool (device) at the disc, lowering the device to either the front or back of the disc and gently pushing the suction cup onto the disc. Then, the disc is brought to any level or position to facilitate removal for storage or throwing. One need not bend, stoop, or squat.

My design is truly a one-handed tool, and those golfers (players) confined to a wheelchair or are otherwise disabled can play disc golf and retrieve their own discs quickly and easily. With the tool in the stowed (folded) position, simply holding the top section and flicking the hand downward "sets" the device for use. This design of loose fitting tubular section ends and a tight length of shock cord enables the tool to be quickly flicked and extended with one hand, in one motion. This design uses lightweight fiberglass tubes with steel sleeves pressed and glued between them for a positive slip fit.

Other designs require a machining of tubes to have an end fit into another end without the sleeve and is impractical to build because this type of section-connective joint would have to start with a solid fiberglass rod and be drilled and machined to male and female ends accordingly. The other designs only use a metal "hook" type mechanism which must be screwed onto the end of the tool. This action itself takes two hands and adds a step for tool setup and use. Then, the hook must be carefully positioned under the disc and the player must be balanced, steady and lucky enough to pick up the disc. Another design uses a heavy and cumbersome clamping mechanism and is not practical or useful.

My design has a suction cup semi-permanently attached by way of friction and a small, horizontal cotter pin, or clip, or alternately, friction mounted utilizing a small stub. The cup itself can bend and wobble, allowing retrieval of discs at extreme angles. Cups can be user-substituted or changed after normal wear causes degradation of suction. This design is 33 inches in length consisting of 3 sections of 11 inches. This overall length is the average length of a walking cane. This size, as collapsed, allows the device to be carried in a pocket, a pouch, or zipped inside the golf bag. This is a proven design and two identical models have been made and field tested under all weather and disc golfing conditions.

I claim my invention is:

1. A tubular, segmented, extensible folding pick up tool comprising:

tubing segments, each having an attached coupling sleeve with a female diameter sized to receive mating male segments whereby all of the segments can be connected together male-female and thereby form a tool shaft;

a length of elastic stretch cord laced through a center hole of all connected tubing segments and having finite pre-tension applied and secured in place at both ends with a knot to anchor the cord ends, fashioned to allow the tool to be extended and deployed with cord tension holding all segments together or held in a collapsed state after having pulled all segments apart and folded;

a cap, fitted on a non-coupling sleeved end of the tool shaft;

a user-changeable suction cup fitted on a coupling sleeved end of the tool shaft, fashioned to be pressed against a surface of a golf disc or a flying plastic disc and create a suction bond to enable pick up of the golf disc or flying plastic disc.

2. The extensible, folding pick up tool of claim 1, further comprising a tool in which said tubing segments do not exceed ⅜ inches in diameter.

3. The extensible, folding pick up tool of claim 1, further comprising a tool fashioned to be used with only one hand to grasp, deploy, extend and pick up a golf disc or flying plastic disc.

* * * * *